US007686671B2

(12) United States Patent
Gotou et al.

(10) Patent No.: US 7,686,671 B2
(45) Date of Patent: Mar. 30, 2010

(54) RADIO CONTROL TWO-WHEEL VEHICLE TOY

(75) Inventors: Takeo Gotou, Taito-ku (JP); Hideaki Takiguchi, Taito-ku (JP)

(73) Assignee: Taiyo Kogyo Co., Ltd., Tokyo (JP)

( * ) Notice: Subject to any disclaimer, the term of this patent is extended or adjusted under 35 U.S.C. 154(b) by 198 days.

(21) Appl. No.: 11/820,630

(22) Filed: Jun. 20, 2007

(65) Prior Publication Data

US 2007/0298678 A1 Dec. 27, 2007

(30) Foreign Application Priority Data

Jun. 23, 2006 (JP) ..... 2006-173503

(51) Int. Cl.
*A63H 17/00* (2006.01)

(52) U.S. Cl. ..... 446/440

(58) Field of Classification Search ..... 446/440, 446/431

See application file for complete search history.

(56) References Cited

U.S. PATENT DOCUMENTS 4,153,268 A * 5/1979 Wilson et al. ..... 280/296
4,309,841 A * 1/1982 Asano ..... 446/440
4,342,175 A * 8/1982 Cernansky et al. ..... 446/440
5,816,888 A * 10/1998 Myers ..... 446/456
6,113,459 A * 9/2000 Nammoto ..... 446/454
6,786,796 B2 * 9/2004 Suto ..... 446/440
6,854,547 B2 * 2/2005 Moll et al. ..... 180/167
2005/0250414 A1 * 11/2005 Leonov et al. ..... 446/454

FOREIGN PATENT DOCUMENTS

JP 61-4699 1/1986
JP 62-61293 4/1987
JP 2004-167116 6/2004

* cited by examiner

*Primary Examiner*—Gene Kim
*Assistant Examiner*—Joseph B Baldori
(74) *Attorney, Agent, or Firm*—Jordan and Hamburg LLP

(57) ABSTRACT

A radio control toy vehicle having a two-wheel vehicle body includes a turnably mounted front fork to which a steering section is operatively connected, a front wheel mounted on the front fork through a front wheel shock absorber, a drive case on which a rear wheel mounted on a rear side of the vehicle body is mounted, a wheelie mechanism for shifting the vehicle body to a running state in which the vehicle body runs using the rear wheel while elevating the front wheel above the ground by temporarily pulling up the front wheel against springs provided on the front fork and then, by releasing the pulling up motion and applying a pushing down force to the front wheel by a restoring force of the springs, and a receiver for receiving a control signal from a transmitter and producing a running control signal.

10 Claims, 12 Drawing Sheets

RADIO CONTROL TWO-WHEEL VEHICLE TOY

BACKGROUND OF THE INVENTION

1) Field of the Invention

In a remote control two-wheel vehicle running toy, the present invention relates to a radio control two-wheel vehicle toy capable of performing a stunt running such as wheelie in which the two-wheel vehicle runs using a rear wheel only while keeping floating a front wheel from the ground.

2) Description of the Related Art

Conventionally, in a field of a two-wheel vehicle running toy such as radio control bicycle or motorcycle, various proposals have been made for realizing stable straight running and lateral turning. The present applicant proposes a radio control two-wheel vehicle toy capable of reducing the number of parts with a simple structure, and capable of stabilizing the running state (see Japanese Patent Application Laid-open No. 2004-167116 (pages 2 to 4, FIGS. 1 to 4) for example).

SUMMARY OF THE INVENTION

In a conventional radio control two-wheel vehicle toy, it is possible to stably straightly run and laterally turn by a front wheel and a rear wheel, but it is difficult to realize a mechanism for remotely controlling a stunt running such as the wheelie in which the two-wheel vehicle runs using the rear wheel only while keeping floating the front wheel from the ground. That is, in the two-wheel vehicle toy, when a normal two-wheel running state using both the front wheel and rear wheel is shifted to the wheelie running state, it is necessary to bring up the front wheel. If an attempt is made to carry out this action by moving a barycenter by varying an attitude of a doll model riding on the two-wheel vehicle toy, the mechanism becomes extensive and large scale mechanism, and there is a problem that an outward appearance of the two-wheel running vehicle toy such as the motorcycle is largely deteriorated. Further, when performing the wheelie running, since the motorcycle is supported only by the one wheel, i.e., the rear wheel, and it is difficult to keep balance thereof, and to continue the wheelie running.

The present invention has been accomplished in view of the circumstances, and it is an object of the invention to provide a radio control two-wheel vehicle toy capable of stably performing the wheelie running using only the rear wheel with a simple structure without largely changing the outward appearance.

To achieve the above object, a first aspect of the invention provides a radio control two-wheel vehicle toy comprising a two-wheel vehicle body, a front fork which is turnably mounted such that a running direction can be changed through a caster shaft which is inclined by a steering section provided on a front side of the two-wheel vehicle body, a front wheel which is rotatably mounted on a shaft through a front wheel shock absorber having a spring on the front fork, a drive case for accommodating therein a running drive section having a rear wheel drive motor mounted on a rear side of the two-wheel vehicle body, a rear wheel which is mounted on the running drive section of the drive case such that the rear wheel can be driven, a wheelie mechanism for shifting the two-wheel vehicle body to a running state in which the two-wheel vehicle body runs using the rear wheel while floating the front wheel from the ground by temporarily pulling up the front wheel against a spring provided on the front fork and then, by releasing the pulling up motion and applying a pushing down force to the front wheel by a restoring force of the spring, and a receiver mounted on the two-wheel vehicle body for receiving a control signal sent from a transmitter and producing a running control signal. Since the wheelie mechanism which applies the pushing down force to the front wheel by the restoring force of the spring is provided, it is possible to stably perform the wheelie running only by the rear wheel with a simple mechanism without largely changing the outward appearance.

According to a second aspect of the invention, the front wheel shock absorber of the front fork is mounted such that an impact received by the front wheel from the ground during running is transmitted to the spring and absorbed by the spring, the wheelie mechanism includes a drive shaft which is mounted on a side surface of the front fork such that the front wheel can be pulled up against a biasing force of the spring, and a wheelie drive section which applies a pulling up force to the drive shaft and which releases the pulling up force. The drive shaft which is slidably mounted on the side surface of the front fork is provided with the wheelie drive section which applies the pulling up force and releases this force. With this, it is possible to perform the wheelie running easily.

According to a third aspect of the invention, the wheelie drive section has a mechanism which is pulled up and driven when teeth formed on a pinion which is rotated and driven by a shaft drive motor mesh with teeth of a rack formed on a side of an upper end of the drive shaft, and which releases the pulling up force when the meshed state of the teeth is released. With this, it is possible to realize the mechanism capable of easily performing the wheelie running by the mechanism which meshes the teeth of the pinion and the teeth of the rack formed on the drive shaft.

According to a fourth aspect of the invention, the wheelie drive section includes a limit switch which detects an instant when the pulling up force to the drive shaft is released, and the receiver which receives an operation signal of the limit switch starts motion of the rear wheel drive motor. The wheelie drive section includes the limit switch which detects the instant when the pulling up force to the drive shaft is released. With this, it is possible to reliably perform the wheelie running.

According to a fifth aspect of the invention, the two-wheel vehicle body is provided at its rear side with a rear portion support section which comes into contact with the ground and rotates during wheelie running on the ground by the rear wheel to prevent the two-wheel vehicle body from falling rearward. The rear portion support section can prevent the radio control two-wheel vehicle toy from falling rearward during the wheelie running.

According to a sixth aspect of the invention, the rear wheel is provided with a ring-like shaped flywheel made of metal material. It is possible to stably continue the running by the gyro effect of the flywheel provided on the rear wheel.

There is provided a radio control two-wheel vehicle toy comprising a two-wheel vehicle body, a front fork which is turnably mounted such that a running direction can be changed through a caster shaft which is inclined by a steering section provided on a front side of the two-wheel vehicle body, a front wheel which is rotatably mounted on a shaft through a front wheel shock absorber having a spring on the front fork, a drive case for accommodating therein a running drive section having a rear wheel drive motor mounted on a rear side of the two-wheel vehicle body, a rear wheel which is mounted on the running drive section of the drive case such that the rear wheel can be driven, a wheelie mechanism for shifting the two-wheel vehicle body to a running state in which the two-wheel vehicle body runs using the rear wheel while floating the front wheel from the ground by temporarily pulling up the front wheel against a spring provided on the front fork and then, by releasing the pulling up motion and applying a pushing down force to the front wheel by a restoring force of the spring, and a receiver mounted on the two-wheel vehicle body for receiving a control signal sent from a transmitter and producing a running control signal. Since the wheelie mechanism which applies the pushing down force to the front wheel by the restoring force of the spring is provided, it is possible to stably perform the wheelie running only by the rear wheel with a simple mechanism without largely changing the outward appearance.

DETAILED DESCRIPTION OF THE INVENTION

Figure 1:
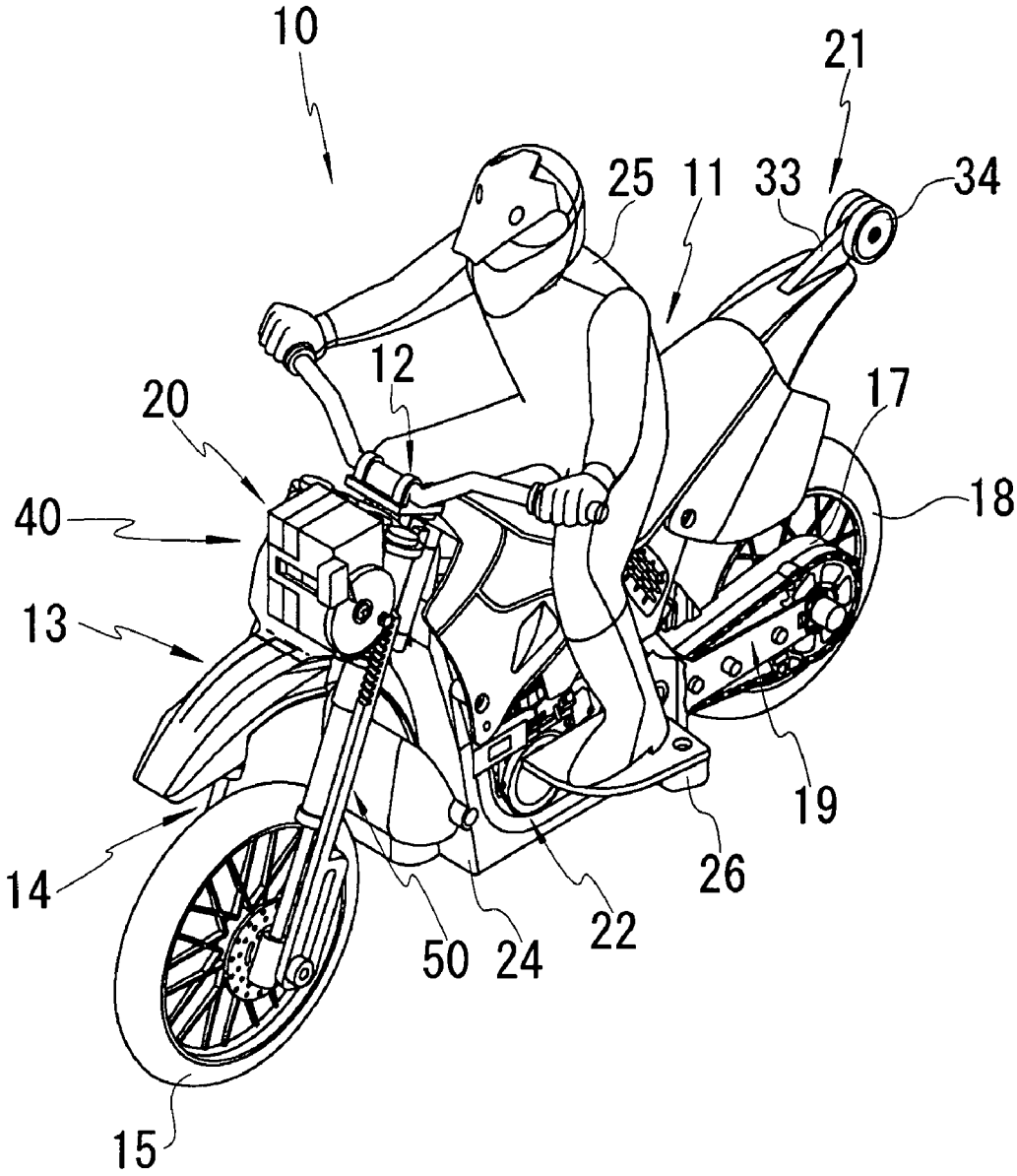
FIG. 1 is a perspective view of a radio control two-wheel vehicle toy of an embodiment of the present invention.
Figure 2:
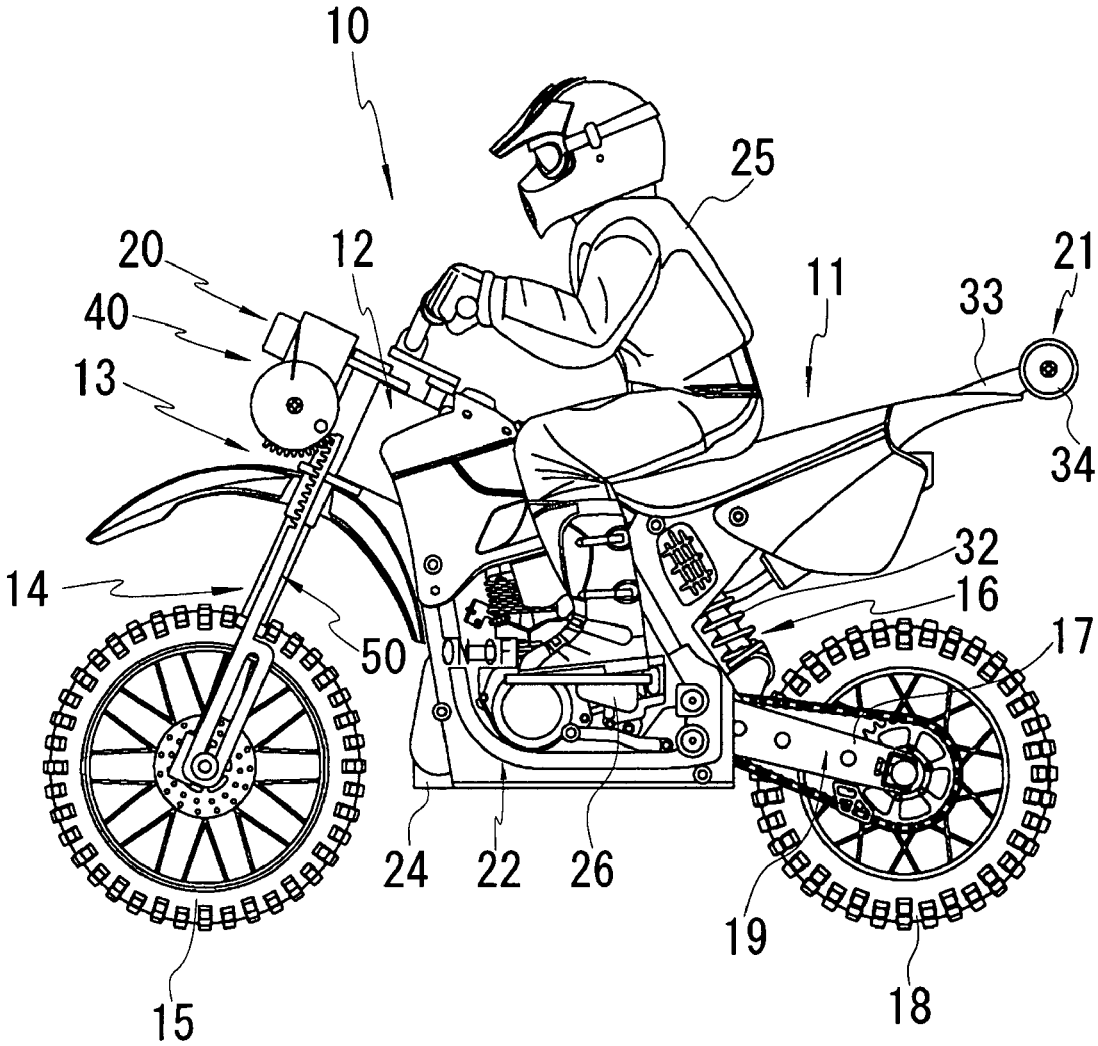
FIG. 2 is a side view of the radio control two-wheel vehicle toy of the embodiment of the invention.
Figure 3:
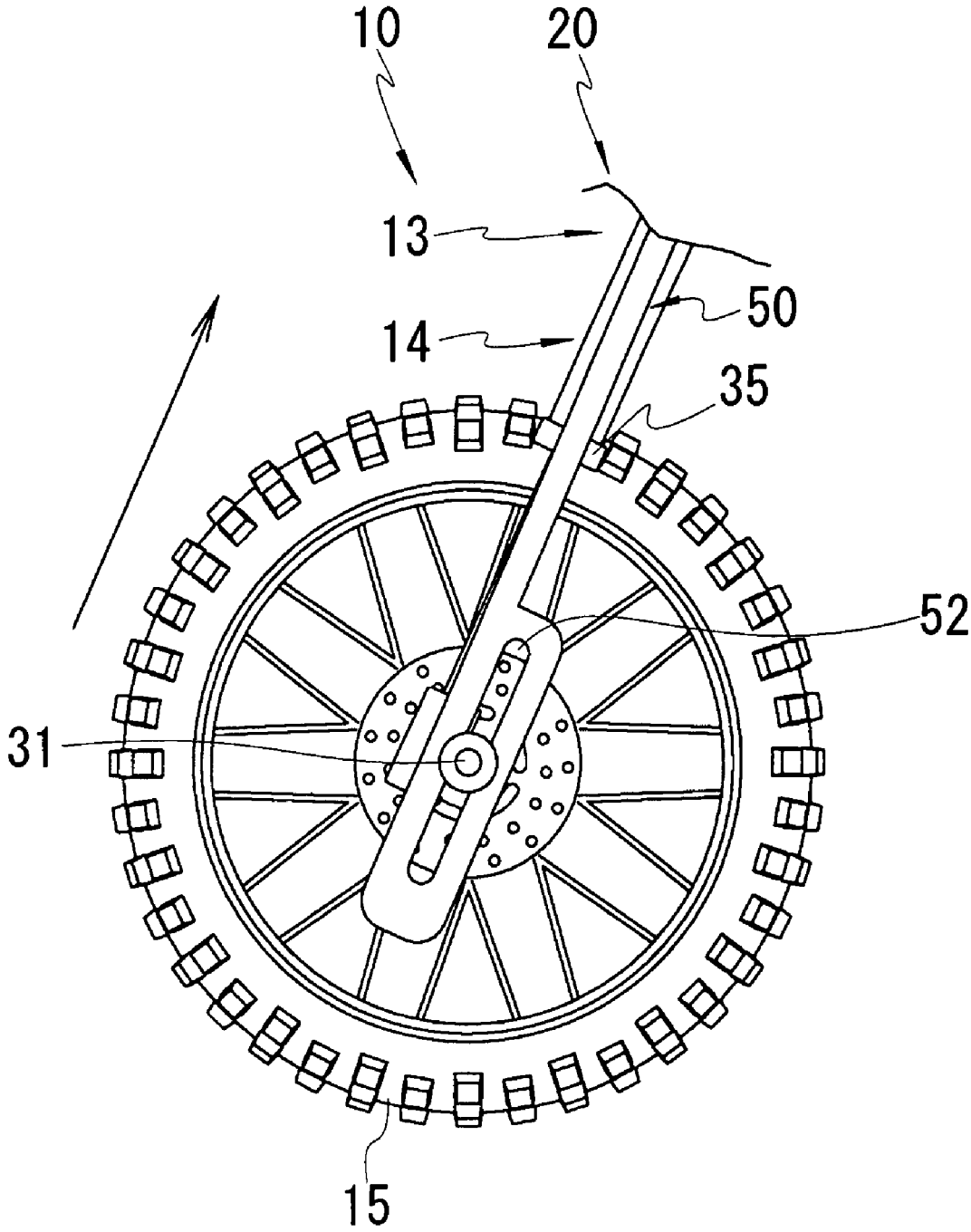
FIG. 3 is an enlarged view of a front wheel portion of the radio control two-wheel vehicle toy of the embodiment of the invention.
Figure 4:
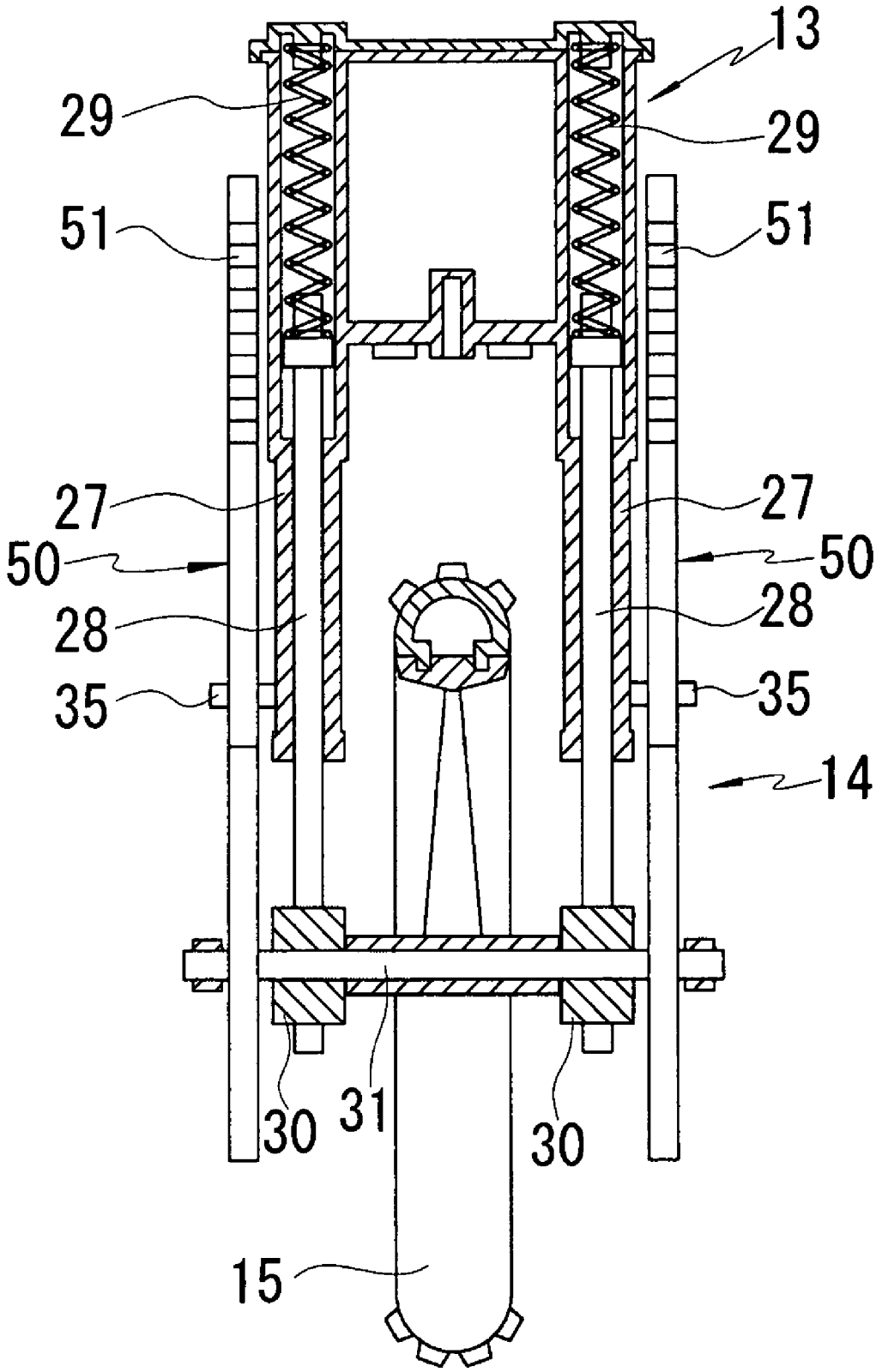
FIG. 4 is a sectional view a front fork and a front wheel portion of the embodiment of the invention.
Figure 5:
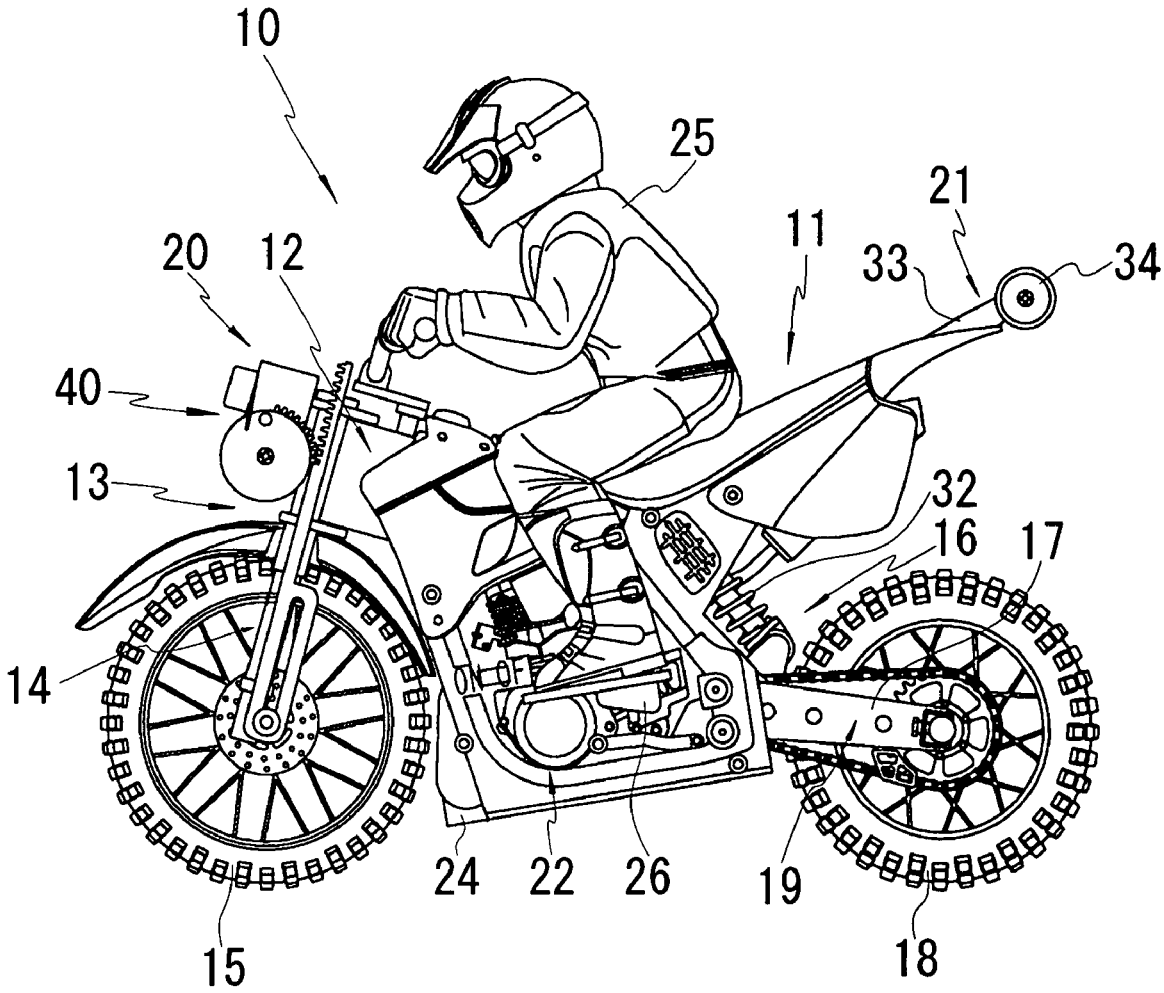
FIG. 5 is a side view of the radio control two-wheel vehicle toy before wheelie action according to the embodiment of the invention.
Figure 6:
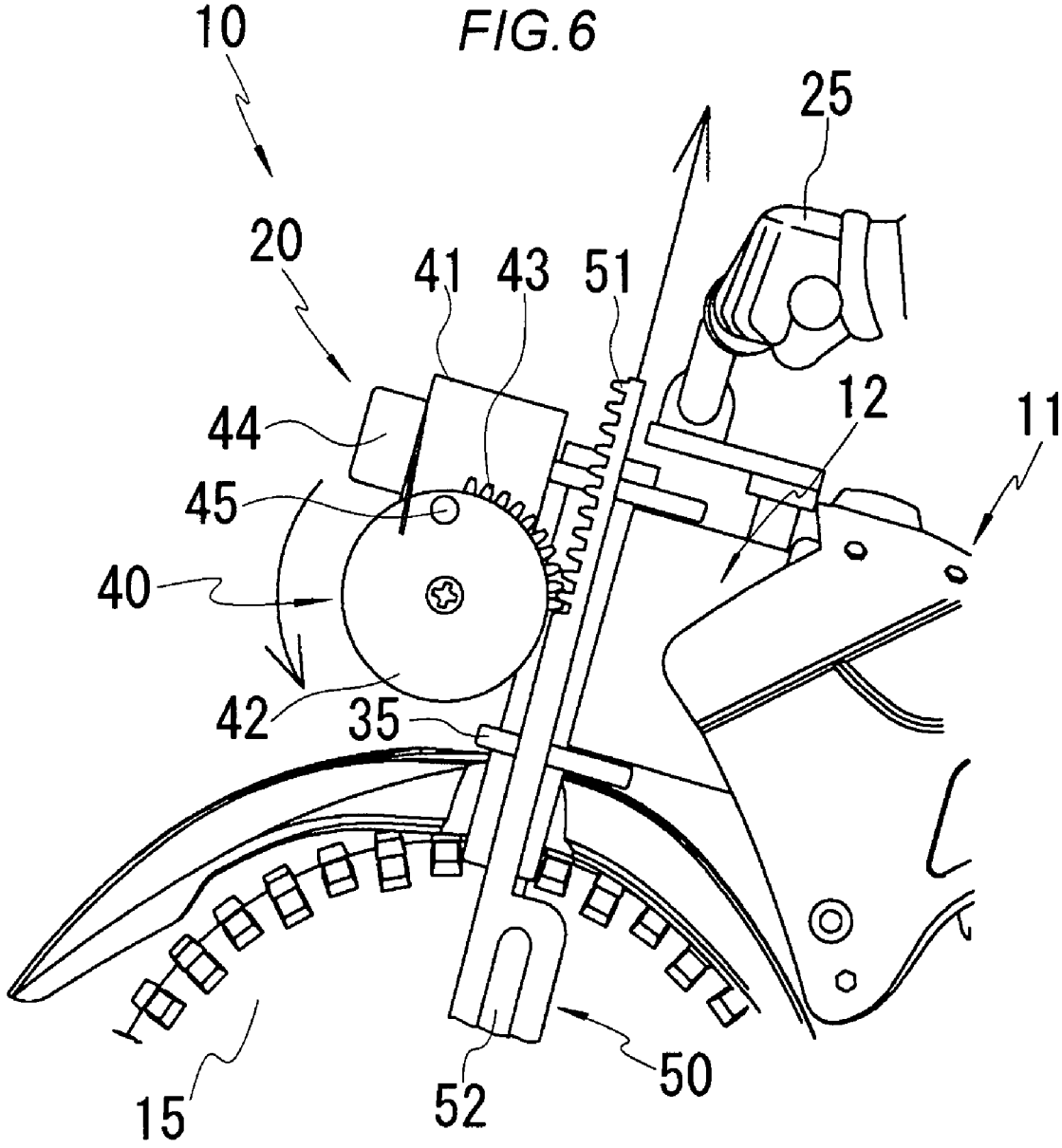
FIG. 6 is an enlarged view of a wheelie mechanism portion of the radio control two-wheel vehicle toy shown in FIG. 5 according to the embodiment of the invention.
Figure 7:
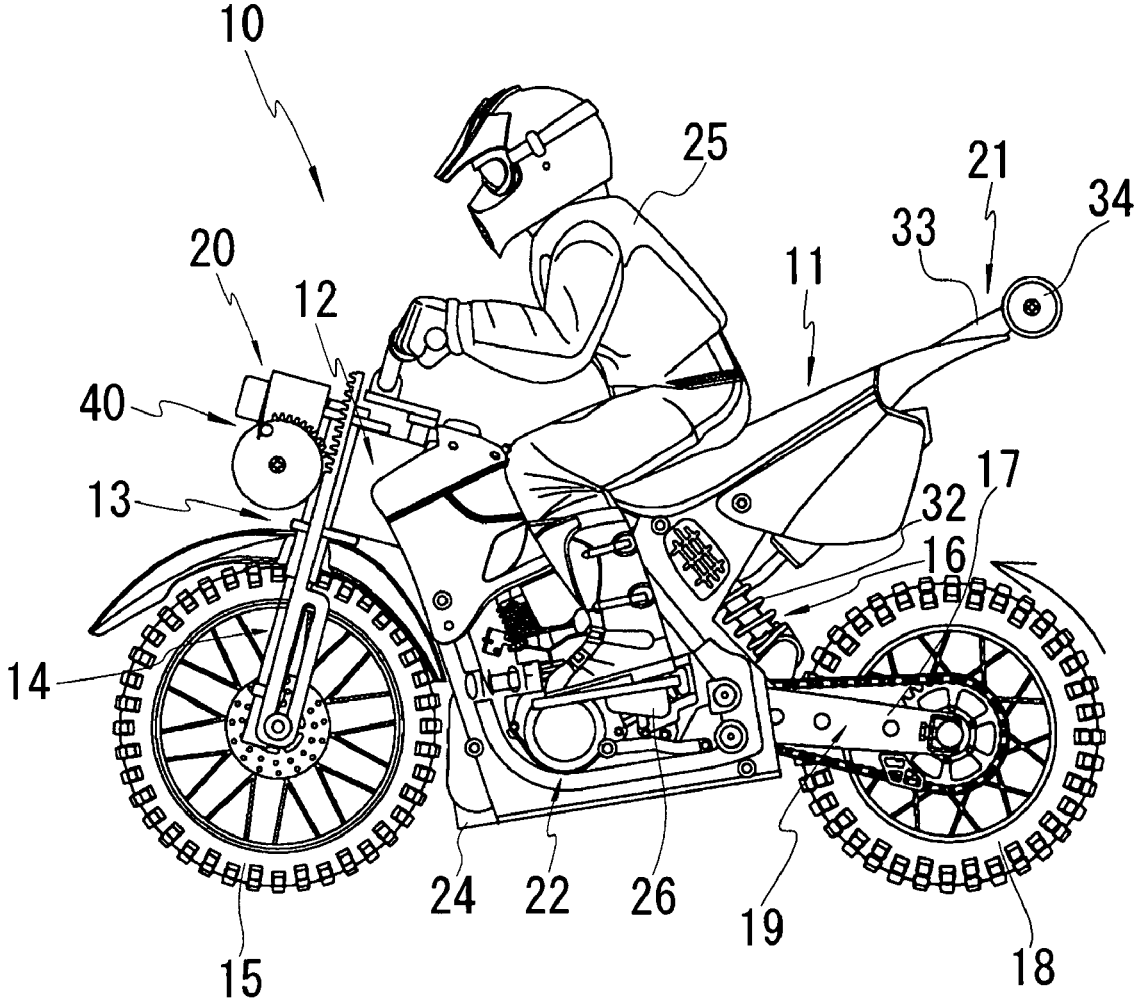
FIG. 7 is a side view of the radio control two-wheel vehicle toy for explaining a switching action in the wheelie action according to the embodiment of the invention.
Figure 8:
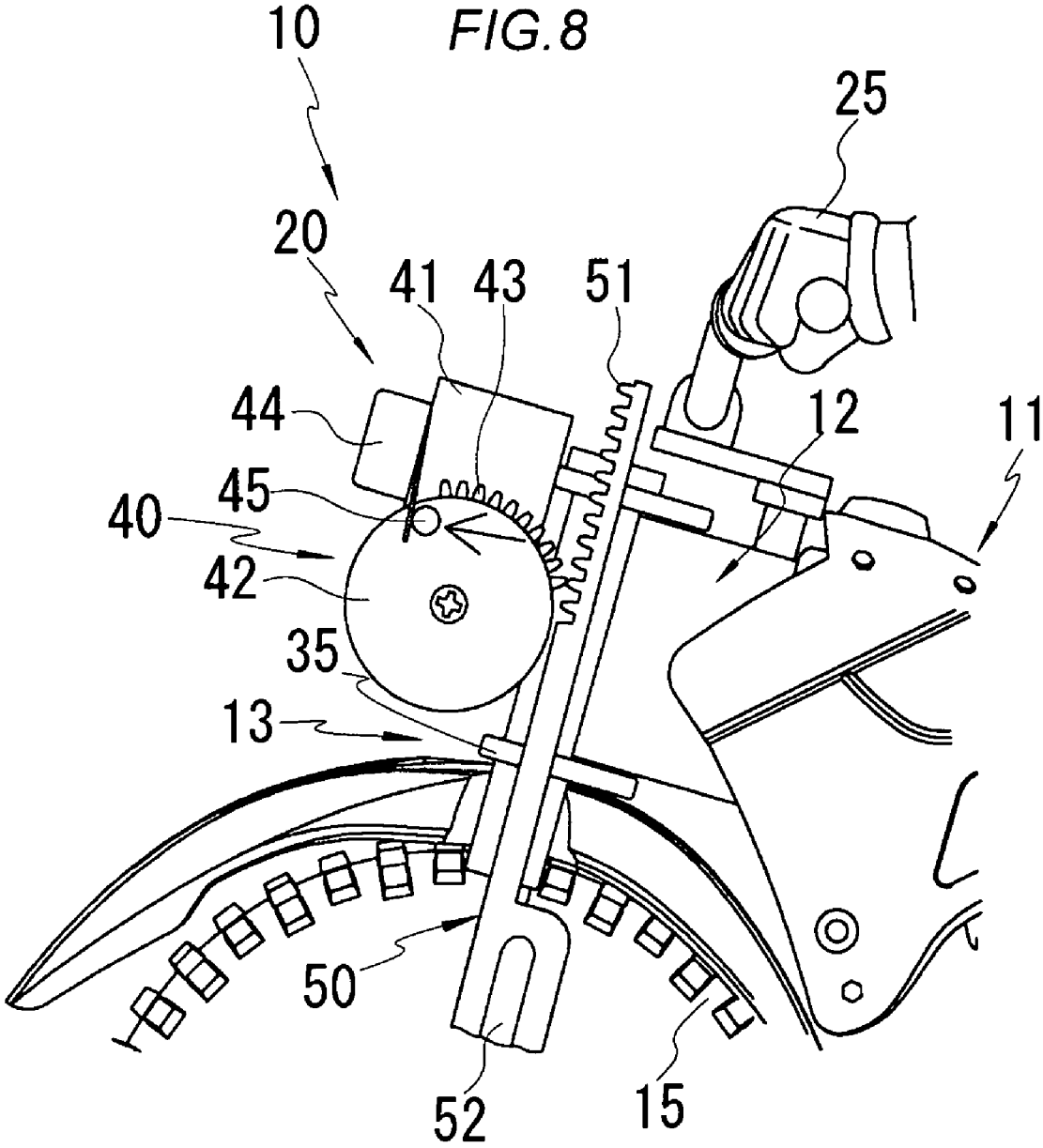
FIG. 8 is an enlarged view of the wheelie mechanism portion of the radio control two-wheel vehicle toy shown in FIG. 7 according to the embodiment of the invention.
Figure 9:
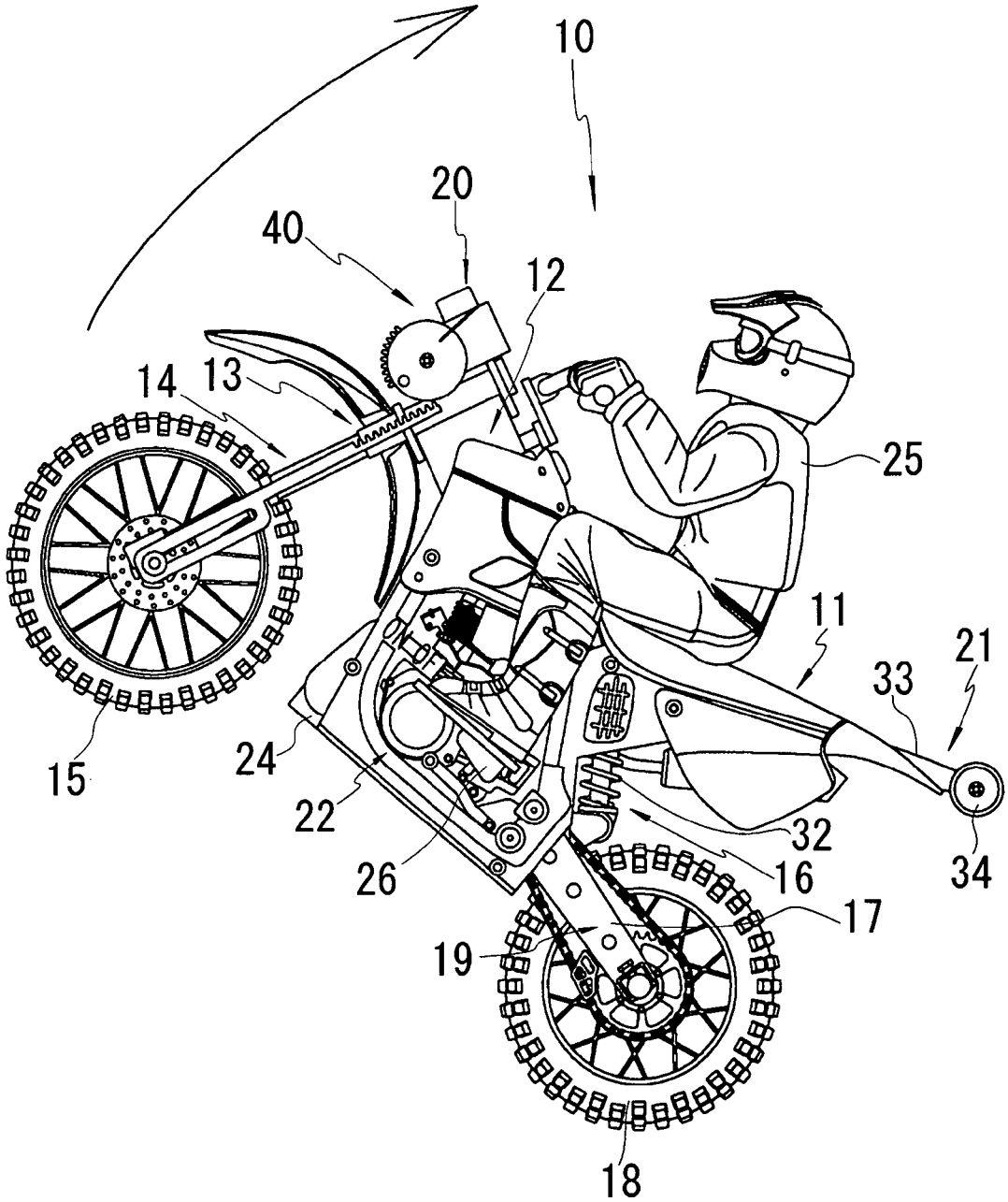
FIG. 9 is an explanatory view of a state in which a running state of the radio control two-wheel vehicle toy is shifted to the wheelie action according to the embodiment of the invention.
Figure 10:
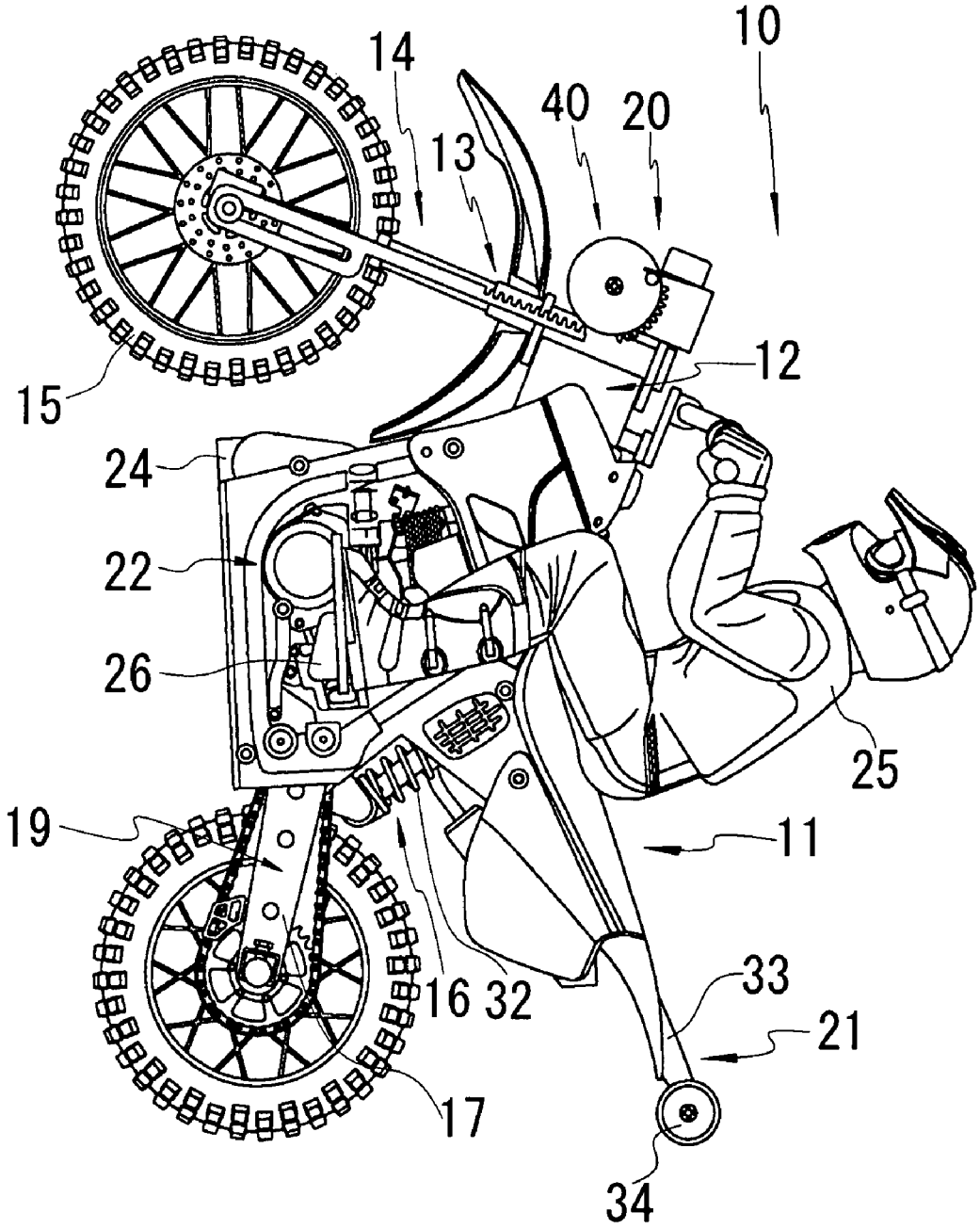
FIG. 10 is an explanatory view of a state in which the wheelie action of the radio control two-wheel vehicle toy is being performed according to the embodiment of the invention.
Figure 11:
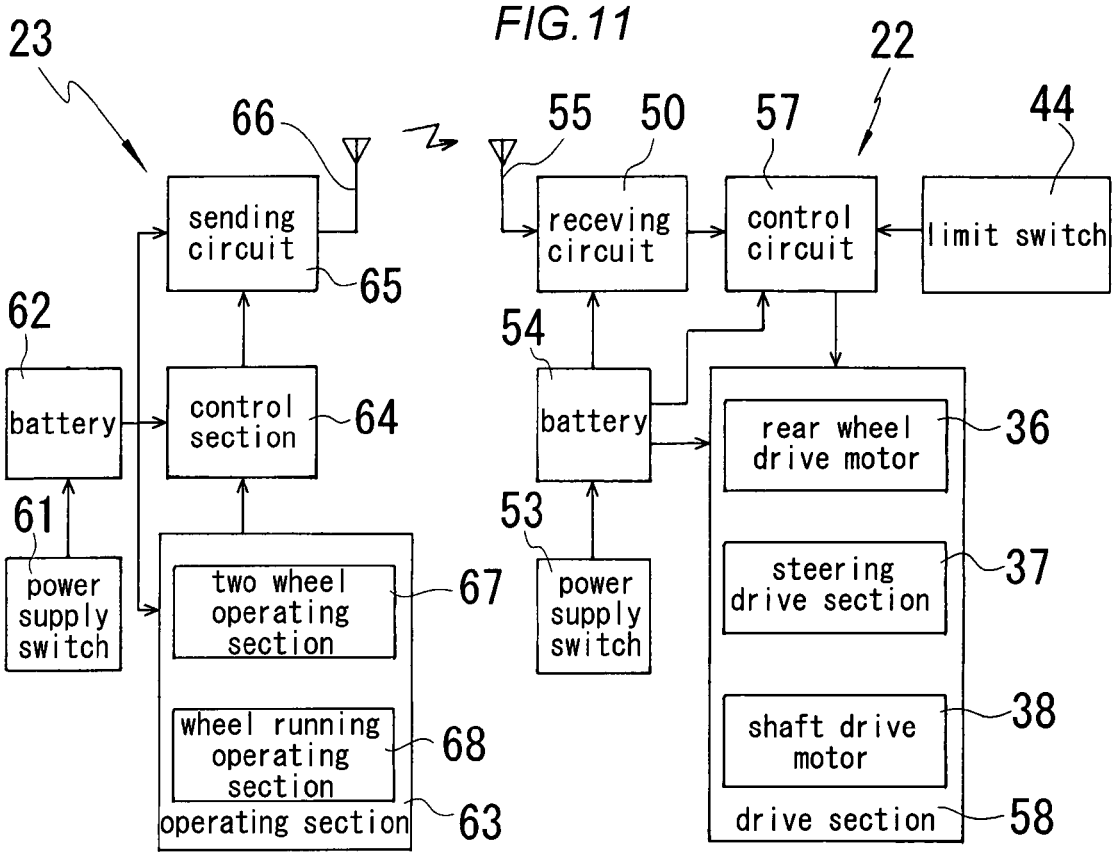
FIG. 11 is an explanatory block diagram of a transmitter and a receiver of the radio control two-wheel vehicle toy according to the embodiment of the invention.

The present invention will be explained more concretely by way of an illustrated embodiment. FIGS. 1 to 11 are explanatory diagrams of a radio control two-wheel vehicle toy of the embodiment of the invention. FIG. 1 is a perspective view of the radio control two-wheel vehicle toy, FIG. 2 is a side view of the radio control two-wheel vehicle toy, FIG. 3 is an enlarged view of a front wheel portion of the radio control two-wheel vehicle toy, FIG. 4 is a sectional view of a front fork and a front wheel portion, FIG. 5 is a side view of the radio control two-wheel vehicle toy before wheelie action, FIG. 6 is an enlarged view of a wheelie mechanism portion of the radio control two-wheel vehicle toy shown in FIG. 5, FIG. 7 is a side view of the radio control two-wheel vehicle toy for explaining a switching operation of the wheelie action, FIG. 8 is an enlarged view of the wheelie mechanism portion of the radio control two-wheel vehicle toy shown in FIG. 7, FIG. 9 is an explanatory diagram of a shifting state to the wheelie action of the radio control two-wheel vehicle toy, FIG. 10 is an explanatory diagram of wheelie action of the radio control two-wheel vehicle toy, and FIG. 11 is a explanatory block diagram of structures of a transmitter and a receiver of the radio control two-wheel vehicle toy.

In these drawings, the radio control two-wheel vehicle toy 10 of the embodiment can straightly run and laterally turn using the two wheels by normal radio control, and can perform wheelie running in which the two-wheel vehicle runs using a rear wheel only while keeping floating a front wheel from the ground. The radio control two-wheel vehicle toy 10 includes a two-wheel vehicle body 11, a front fork 13 which is turnably mounted so as to change the running direction through an inclined caster shaft by a steering section 12 provided on a front side of the two-wheel vehicle body 11, a front wheel 15 which is rotatably mounted on the front fork 13 through a front wheel shock absorber 14, a drive case 17 for accommodating a running drive section 19 mounted on a rear side of the two-wheel vehicle body 11 through a rear wheel shock absorber 16, a rear wheel 18 mounted on the running drive section 19 of the drive case 17, a wheelie mechanism 20 for shifting a normal running state to a wheelie state in which the two-wheel vehicle run using only the rear wheel 18 provided on the front fork 13, a rear portion support section 21 mounted on an upper portion of a rear side of the two-wheel vehicle body 11, and a receiver 22 mounted on the two-wheel vehicle body 11 for receiving a control signal sent from a transmitter 23 for controlling the running state.

The two-wheel vehicle body 11 is made of molding material such as plastic, and includes a vehicle body 24 modelled upon a motorcycle as a whole, a doll model 25 riding on the vehicle body 24, and side support portions 26 mounted on left and right lower sides of a central portion of the vehicle body 24 and on which feed of the doll model 25 are put. In a state where the radio control two-wheel vehicle toy 10 is stopped, the side support portions 26 are in contact with the ground so that the two-wheel vehicle body 11 does not fall and the side support portions 26 can maintain the inclined attitude. The receiver 22 which will be described in detail is mounted on the lower side of the doll model 25 at the central portion of the vehicle body 24.

The steering section 12 has a steering drive section 37 comprising an electromagnetic coil and a permanent magnet. The steering drive section 37 is accommodated in a case. A lateral turning motion of the electromagnetic coil of the steering drive section 37 is transmitted to the front fork 13 through the caster shaft provided on an upper portion of a front side of the two-wheel vehicle body 11 based on a control signal from the receiver 22, and if the front fork 13 laterally turns around the caster shaft, the lateral running direction can be changed.

As shown in FIG. 4, the front fork 13 is integrally molded with a pair of left and right support pipes 27 and 27 whose upper sides are mounted through parallel plate materials using plastic. Springs 29 and 29 are accommodated in upper sides of the support pipes 27 and 27 such that the springs 29 and 29 can expand and contract. Support shafts 28 and 28 are movably accommodated in lower sides of the support pipes 27 and 27. Upper ends of the support shafts 28 and 28 are mounted on lower ends of the springs 29 and 29 so that the support shafts 28 and 28 can move in the support pipes 27 and 27. Lower ends of the support shafts 28 and 28 further project from lower portions of the support pipes 27 and 27. The lower ends of the support shafts 28 and 28 are mounted on holding members 30 and 30 for holding the front wheel 15 respectively. A shaft 31 slightly projects laterally from the holding members 30 and 30. Both ends of the shaft 31 are horizontally mounted on the holding members 30 and 30. The front wheel 15 is rotatably mounted between the holding members 30 and 30 of the shaft 31. That is, the support shafts 28 and 28 which are movably mounted in the support pipes 27 and 27 of the lower sides of the front fork 13 through biasing forces of the springs 29 and 29 constitute the front wheel shock absorber 14. An impact received by the front wheel 15 from the ground during running is transmitted from the support shafts 28 and 28 to the springs 29 and 29 through the shaft 31 and the holding members 30 and 30 and absorbed.

The drive case 17 is a laterally long case in which the rear wheel drive motor 36 and the running drive section 19 is accommodated. The running drive section 19 drives the rear wheel 18 such as a gear train for transmitting a rotation force of the rear wheel drive motor 36. One end of a front side of the drive case 17 is turnably mounted on a rear side of the vehicle body 24 through the rear wheel shock absorber 16. The rear wheel 18 is mounted on a side surface of a rear side of the drive case 17 such that the rear wheel 18 is rotated by the gear train. A flywheel is integrally provided on the rear wheel 18 at an interior of a portion corresponding to a tire which comes into contact with the ground and rotates. The flywheel is made of such as ring-like shaped metal material. The flywheel rotates at the same speed as that of the rear wheel 18 so that stability of the running state is secured by a gyro effect. To obtain such a gyro effect, the rear wheel 18 except the tire may be made of such as metal material. The rear wheel shock absorber 16 comprises such as a spring 32 mounted between a rear side of the vehicle body 24 and an upper portion of a front side of the drive case 14. That is, an impact received by the rear wheel 18 from the ground during running can be absorbed by the spring 32 through the drive case 17.

When the wheelie running is performed only by the rear wheel 18, the rear portion support section 21 stably continues the wheelie running. The rear portion support section 21 includes a mount portion 33 provided on a rear side of the vehicle body 24, and a small wheel 34 which is rotatably provided on an end of the mount portion 33. The small wheel 34 of the rear portion support section 21 comes into contact with the ground and rotates during the wheelie running on the ground by the rear wheel 17 shown in FIG. 10. The small wheel 34 can also prevent the vehicle from falling toward the rear side.

The wheelie mechanism 20 includes a pair of drive shafts 50 and 50 mounted on a side of the front fork 13 such that the drive shafts 50 and 50 can pull up the front wheel 15 against biasing forces of the springs 29 and 29. The wheelie mechanism 20 also includes a wheelie drive section 40 which applies a pulling up force to the drive shafts 50 and 50 and releases the same. The wheelie drive section 40 includes such as a drive case 41, a shaft drive motor 38 accommodated in the drive case 41, pinions 42 and 42 provided on both sides of the drive case 41 and rotated by the shaft drive motor 38, and a limit switch 44 which is mounted on the drive case 42 and is operated when one of the pinions 42 rotates. The drive shafts 50 and 50 are driven by the pinions 42 and 42. The drive case 41 is mounted on an upper portion of a front side of the front fork 13. The pinions 42 and 42 are respectively provided on left and right sides of the drive case 41, and are rotated by the shaft drive motor 38 at the same time in the same direction. The shaft drive motor 38 is rotated based on a signal from a control section 57 of the receiver 22 for the wheelie action. The receiver 22 will be explained in detail later. The pinions 42 and 42 are formed into small disk shapes and are formed only at their portions with teeth 43 and 43. The limit switch 44 is mounted on the front side of the drive case 41. The limit switch 44 switches during rotation of one of the pinions 42 by a projection 45 mounted on a side of the one pinion 42. The rotation of the pinion 42 and the switching action of the limit switch 44 will be explained in detail later. The drive shafts 50 and 50 are formed into thin and long rods. The drive shafts 50 and 50 are mounted on sides of a pair of left and right support pipes 27 and 27 in front fork 13 such that the drive shafts 50 and 50 can move in the same direction as the axial directions of the support shafts 28 and 28. Upper end portions of the drive shafts 50 and 50 which are opposed to the pinions 42 and 42 mesh with teeth 43 and 43 of the pinions 42 and 42 which rotate, and are formed with teeth 51 and 51 as racks which convert rotation motion to straight motion. Widths of lower ends of the drive shafts 50 and 50 are slightly wide, and long holes 52 and 52 are formed in those portions along axial line directions of the support shafts 28 and 28. Left and right ends of the shaft 31 of the front wheel 15 slightly projecting laterally from the holding members 30 and 30 movably penetrate the long holes 52 and 52 of the drive shafts 50 and 50 so that the left and right ends of the shaft 31 do not come out. The drive shafts 50 and 50 are mounted in substantially a central portion such that the drive shafts 50 and 50 can slide by guidance holding sections 35 and 35 provided on left and right side surfaces of the support pipes 27 and 27. That is, in a state where the wheelie mechanism 20 is not operated, when it is transmitted to the springs 29 and 29 in the front wheel shock absorber 14 by an impact received by the front wheel 15 from the ground and the support shafts 28 and 28 vertically move, both the left and right ends of the shaft 31 of the front wheel 15 can move in the long holes 52 and 52. When the wheelie mechanism 20 is operated, and when the teeth 43 and 43 of the pinions 42 and 42 mesh the teeth 51 and 51 of the upper portions of the drive shafts 50 and 50 and the drive shafts 50 and 50 are pulled up, the front wheel 15 and both the left and right ends of the shaft 31 of the front wheel 15 can be pulled upward through the support shafts 28 and 28 against biasing forces of the springs 29 and 29 in the lower ends of the long holes 52 and 52. When the support shafts 28 and 28 are pulled upward, since the teeth 43 and 43 of the pinions 42 and 42 are formed on only portions of the peripheries, when the support shafts 28 and 28 are pulled to predetermined height, the engagements between the upper ends of the drive shafts 50 and 50 and the teeth 43 and 43 are released, the pulling up forces of the drive shafts 50 and 50 are released, the drive shafts 50 and 50 are moved downward by the pushing forces of the springs 29 and 29 of the front wheel shock absorber 14, and the front wheel 15 is also pushed downward. The front wheel 15 floats upward from the ground by the pushing down forces of the springs 29 and 29 of the front wheel 15, and the front fork 13, the steering section 12 and the front side of the two-wheel vehicle body 11 start floating around the rear wheel 18. When the pulling up forces of the drive shafts 50 and 50 are released, the limit switch 44 is turned ON by the projection 45 provided on the pinion 42. If the limit switch 44 is turned ON, the control section 57 of the receiver 22 sends a signal for rotating the rear wheel drive motor 36. With this, the two-wheel vehicle can perform the wheelie action only with the rear wheel 18 in which the front wheel 15 floats from the ground. After the limit switch 44 is turned ON, the pinions 42 and 42 further rotate and then stop in preparation for a next wheelie action.

The receiver 22 includes a receiving circuit 50 which receives a signal sent from the transmitter 23 through an antenna 55, a control section 57 which receives a signal received by the receiving circuit 50 and an ON-signal from the limit switch 44 and which sends a control signal to the rear wheel drive motor 36, the steering drive section 37 and the shaft drive motor 38 which constitute a drive section 58, a power supply switch 53, and a battery 54 for supplying electricity to the receiving circuit 50, the control section 57 and the drive section 58 by the power supply switch 53. The constituent elements of the receiver 22 are provided in a central portion of the vehicle body 24.

A person who remotely controls the radio control two-wheel vehicle toy 10 has the transmitter 23 for sending a control signal. The transmitter 23 includes an operating section 63 which has a two-wheel running operating section 67 for instructing the two-wheel vehicle to straightly run or laterally turn, and a wheelie running operating section 68 for instructing the two-wheel vehicle to perform the wheelie running. The transmitter 23 also includes a control section 64 for producing a control signal based on operation of the operating section 63, a sending circuit 65 for sending the control signal of the control section 64 through an antenna 66, a power supply switch 61, and a battery 62 for supplying electricity to the operating section 63, the control section 64 and the sending circuit 65 by the power supply switch 61.

According to the radio control two-wheel vehicle toy 10 having the above-described structure, the power supply switch 53 of the receiver 22 and the power supply switch 61 of the transmitter 23 are turned ON and then, the two-wheel running operating section 67 of the operating section 63 is operated. With this, a running control signal produced by the control section 64 is sent from the sending circuit 65 to the receiver 22 through the antenna 66. The running control signal sent from the transmitter 23 is received by the receiving circuit 50 through the antenna 55 of the receiver 22 mounted on the two-wheel vehicle body 11, and a control signal corresponding to the running control signal is produced in the control section 57 from the receiving circuit 50, and the produced control signal is sent to the rear wheel drive motor 36 or the steering drive section 37 of the drive section 58. With this, if the rear wheel 18 is driven by the rear wheel drive motor 36, the two-wheel vehicle runs straightly, and if the steering drive section 37 of the steering section 12 is driven, this is transmitted to the front fork 13 through the caster shaft, the front fork 13 is turned laterally around the caster shaft and the lateral running direction can be changed. Since the rear wheel 18 is integrally provided with the flywheel, the running stability can be secured by the gyro effect generated by the flywheel.

Next, to perform the wheelie running, if the wheelie running operating section 63 of the operating section 63 of the transmitter 23 is operated when the two-wheel vehicle runs straightly, a control signal for starting the wheelie running produced by the control section 64 is sent to the receiver 22 from the sending circuit 65 through the antenna 66. The control signal for starting the wheelie running is sent from the receiving circuit 50 to the control circuit 57 through the antenna 55, and the control circuit 57 produces a control signal for the wheelie running. That is, when the control section 57 receives a signal for starting the wheelie running, the control section 57 sends, to the rear wheel drive motor 36, a signal for stopping the rear wheel drive motor 36 to temporarily stop the running, and starts the rotation of the shaft drive motor 38. If the shaft drive motor 38 operates, the pinions 42 and 42 are rotated, and the teeth 43 and 43 of the pinions 42 and 42 mesh with the teeth 51 and 51 on the upper ends of the drive shafts 50 and 50, and the drive shafts 50 and 50 are pulled up. The drive shafts 50 and 50 upwardly pull up the front wheel 15 and both the left and right ends of the shaft 31 of the front wheel 15 in the lower ends of the long holes 52 and 52 through the support shafts 28 and 28 against the biasing forces of the springs 29 and 29. When the support shafts 28 and 28 are pulled up, since the teeth 43 and 43 of the pinions 42 and 42 are formed on only portions of the peripheries, when the support shafts 28 and 28 are pulled to predetermined height, the engagements between the upper ends of the drive shafts 50 and 50 and the teeth 51 and 51 are released, the pulling up forces of the drive shafts 50 and 50 are released, the drive shafts 50 and 50 are moved downward by the pushing forces of the springs 29 and 29 of the front wheel shock absorber 14, and the front wheel 15 is also pushed downward. The front wheel 15 floats upward from the ground by the pushing down forces of the springs 29 and 29 of the front wheel 15, and the front fork 13, the steering section 12 and the front side of the two-wheel vehicle body 11 start floating around the rear wheel 18 as shown in FIG. 9. When the pulling up forces of the drive shafts 50 and 50 are released, the limit switch 44 is turned ON by the projection 45 provided on the pinion 42. If the limit switch 44 is turned ON, the control section 57 which receives the ON-signal sends a signal for rotating temporarily stopping rear wheel drive motor 36. With this, the two-wheel vehicle can perform the wheelie action only with the rear wheel 18 in which the front wheel 15 floats from the ground. In this wheelie action, since the rear portion support section 21 is provided on the rear side of the vehicle body 24, the small wheel 34 also comes into contact with the ground and rotates, and this can prevent the two-wheel vehicle from falling rearward and to stably continue the wheelie running. With this, it is possible to stably perform the wheelie running with a simple mechanism without largely changing the outward appearance.

Figure 12:
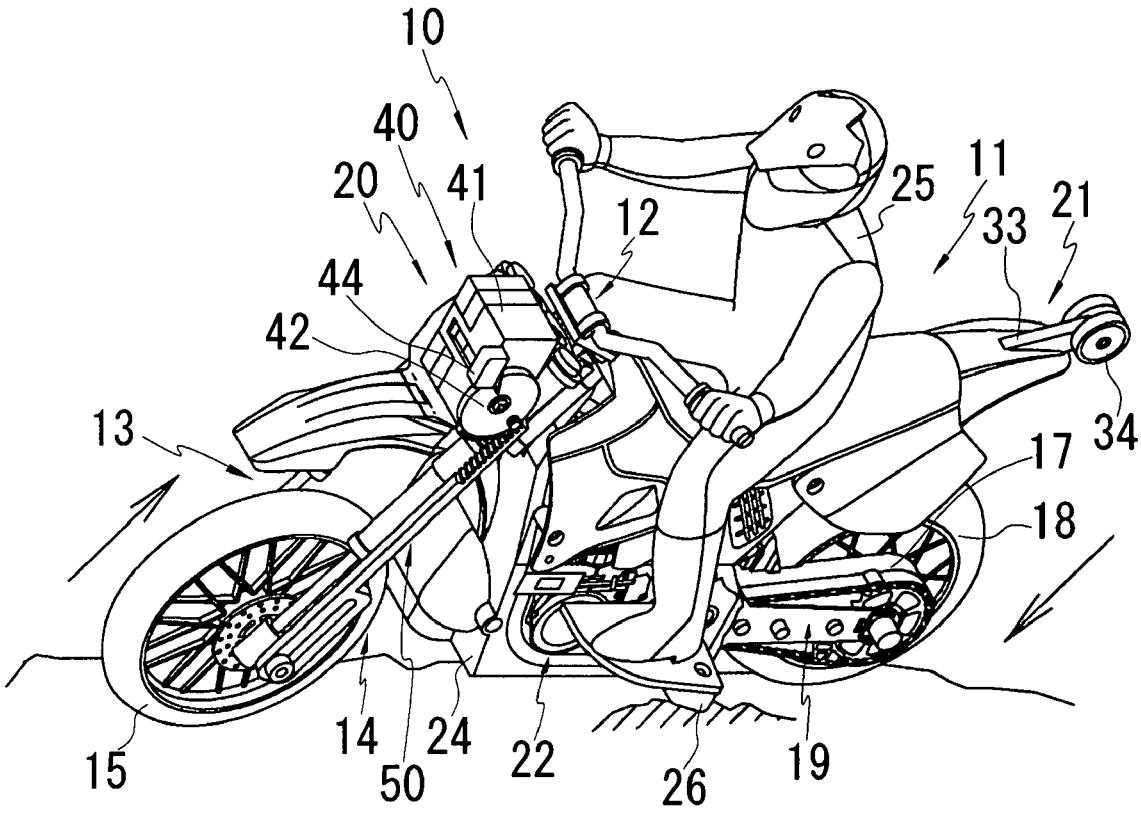
FIG. 12 is an explanatory perspective view of another example of action of the radio control two-wheel vehicle toy according to the embodiment of the invention.

FIG. 12 is an explanatory perspective view of another action example of the radio control two-wheel vehicle toy of the embodiment of the present invention. This action example in this embodiment has a wheelie mechanism 20 of the embodiment and has a unique effect. For example, the radio control two-wheel vehicle toy 10 stops and the side support portion 26 is abutted against the ground and is inclined, the rear wheel 18 slips due to low friction of the ground state and the two-wheel vehicle can not return to its normal straight running state. In such a condition, if the wheelie mechanism 20 of the embodiment is operated, a pushing down force is applied to the front wheel 15 around the side support portion 26, a force for pushing the rear wheel 18 against the ground is applied as a reaction force, the friction force between the rear wheel 18 and the ground is increased, and the two-wheel vehicle can return to its straight running state.

Although the pinions 42 and 42 are rotated by the shaft drive motor 38 as the wheelie mechanism 20 and the drive shafts 50 and 50 are driven by the pinions 42 and 42 in the embodiment, the drive shafts 50 and 50 may be pulled up against the biasing forces of the springs 29 and 29 by a cam mechanism, and it may be opened.

The present invention can be utilized for a radio control two-wheel vehicle toy capable of performing a stunt running such as wheelie in which a front wheel floats and the two-wheel vehicle runs using a rear wheel only.

What is claimed is:

1. A two-wheel toy vehicle arranged to be remotely controlled by signals from a transmitter, said toy vehicle comprising:

a front fork provided on a front side of the toy vehicle;

a front shaft mounted on the front fork;

a front wheel which is rotatably mounted on the front shaft;

a spring assembly having a spring which movably supports the front shaft on the front fork;

a rear wheel provided on a rear side of the toy vehicle; a running drive section having a rear wheel drive motor mounted on the toy vehicle so as to drive the rear wheel;

a controller device configured to receive the signals transmitted by the transmitter and transmit a signal based on the received signals in order to effect a wheelie operation in a wheelie mode of operation;

a spring compression mechanism configured to effect the following operations in response to the signal from the transmitter in order to effect the wheelie operation in the wheelie mode:

compression of the spring in a direction to apply a pulling up force to effect pulling up the front shaft toward the front fork to effect a pulling up motion in response to a signal from said transmitter; and release of the compression of the spring to release the pulling up force and to thereby apply a pushing down force to the front wheel caused by a restoring force of the compressed spring so that the front side of the toy vehicle rises off the ground to perform wheelie action.

2. The two-wheel toy vehicle toy according to claim 1, wherein said spring works to absorb an impact received by the front wheel from ground during running at a normal running mode and to supply, in the wheelie mode, the pushing down force to the front wheel so as to cause the front side of the vehicle to rise off the ground.

3. The two-wheel toy vehicle according to claim 2, wherein the spring compression mechanism comprises a pinion, a driving motor which drives rotation of the pinion and a rack wherein said pulling-up of the shaft is effected by engagement of teeth on the rotating pinion with teeth on the rack, and the release of the pulling up force is effected when the engaged teeth come off the rack.

4. The two-wheel toy vehicle according to claim 1, wherein:

the spring compression mechanism comprises a limit switch which detects a point of the release of the compression of the spring to effect release of the pulling up force on the drive shaft is released; and the controller operates to control the rear wheel drive motor to stop with start of the pulling up of the front shaft, and the rear wheel drive motor to restart when the limit switch detects the release of compression of the spring.

5. The two-wheel toy vehicle according to claim 1, wherein the toy vehicle is further provided at its rear side with a rear portion support member which comes into contact with the ground during the wheelie operation so that the toy vehicle is supported on the ground by the rear wheel and the rear portion support member.

6. The two-wheel toy vehicle according to claim 1, wherein the rear wheel is provided with a flywheel made of metal material.

7. A toy vehicle arranged to be remotely controlled by signals from a transmitter, said vehicle comprising:

a front wheel rotatably disposed at a front portion of the vehicle;

a spring-loaded member having a spring coupled to said front wheel;

a control mechanism arranged to compress the spring and then to release the spring from the compression;

a fly-wheel-loaded rear wheel disposed at a rear portion of said vehicle;

a drive motor arranged to supply a drive power to said rear wheel;

a control means coupled to said drive motor so as to control supply of the drive power to the drive motor; and a rear support member provided at the rear portion of said vehicle so that the vehicle is supported by said rear wheel and an end portion of said rear support member contacting the ground surface when the vehicle is at a wheelie position;

wherein said vehicle is configured to perform:

(a) triggering said control mechanism to compress said spring in response to a signal from said transmitter under control by a user;

(b) temporally halting the supply of the drive power to said rear wheel in concert with the triggering at the step (a);

(c) releasing said spring from the compression, when the compression to the spring reaches a certain state, to supply said front wheel with a downward impact force caused by the release of the compressed spring; and (d) resuming the supply of the drive power to said rear wheel in concert with the release of the spring from the compression at the step (c), wherein, with combined forces caused by the release of said spring from the compression at the step (c) and by acceleration of the vehicle effected by the resumption of the supply of the drive power to the rear wheel at the step (d), the front portion of the vehicle rises off the ground surface so that the vehicle shifts to a wheelie position in which the vehicle is supported by the rear wheel and the rear support member having the end portion contact ground surface.

8. A toy vehicle of claim 7, further comprising an auxiliary wheel provided at the top of the rear support member so that the auxiliary wheel contacts the ground surface at the wheelie mode.

9. A model vehicle arranged to be remotely controlled by signals from a transmitter, said vehicle comprising:

a front shaft disposed at a front portion of the vehicle;

a front wheel rotatably mounted on said front shaft;

a spring loaded member provided with a spring coupled to said front shaft;

a control mechanism arranged to compress said spring and then to release the spring from compression so as to provide a downward impact force to said front wheel;

a flywheel-loaded rear wheel rotatably disposed at a rear portion of said vehicle;

a drive motor arranged to supply a rotation power to said rear wheel;

a control means coupled to said control mechanism and to said drive motor so as to trigger the compression of said spring and so as to control supply of the rotation power; and a rear support member disposed at the rear portion of said vehicle and having an auxiliary wheel so that the vehicle is supported by said rear wheel and said auxiliary wheel contacting the ground surface when the vehicle is at a wheelie position;

wherein said vehicle is programmed to perform the steps of:

(a) triggering actuation of said control mechanism to start the compression of said spring in response to a signal from said transmitter under control by a user;

(b) temporally halting the supply of the rotation power to said rear wheel in concert with the start of the compression at the step (a);

(c) releasing said spring from the compression to provide said front wheel with the downward impact force when the compression to the spring reaches a certain state; and (d) resuming the supply of the rotation power to said rear wheel in concert with the release of the compressed spring at the step (c), wherein the front of the vehicle rises off the ground surface with the impact force caused by the release of the compression from said spring at the step (c) combined with the acceleration to the vehicle effected by the resumption of the supply of the rotation power to the rear wheel at the step (d) and the vehicle shifts to the wheelie position in which the vehicle at the wheelie position is supported by the rear wheel and the rear support member having the auxiliary wheel in contact with the ground surface.

10. A model vehicle of claim 9, further comprising a turnably mounted front fork which movably supports said front shaft so that the front shaft is pulled up relative toward the front fork when the spring is compressed.

* * * * *